US005170994A

United States Patent [19]

Riedl et al.

[11] Patent Number: 5,170,994

[45] Date of Patent: Dec. 15, 1992

[54] RACK AND PINION JACK

[75] Inventors: Reinhold Riedl, Miltenberg; Paul Beck, Freudenberg/Main, both of Fed. Rep. of Germany

[73] Assignee: Haacon Hebetechnik GmbH, Freudenberg/Main, Fed. Rep. of Germany

[21] Appl. No.: 784,503

[22] Filed: Oct. 31, 1991

[51] Int. Cl.[5] ..... B66F 7/26

[52] U.S. Cl. ..... 254/45; 254/95

[58] Field of Search ..... 254/45, 134, 89 R, 89 H, 254/95, 97; 419/515, 512, 390, 495, 498

[56] References Cited

U.S. PATENT DOCUMENTS

| | | | |
|---|---|---|---|
| 3,749,363 | 7/1973 | Hauser | 254/45 |
| 4,045,000 | 8/1977 | Mai | 254/45 |
| 4,619,439 | 10/1986 | Riedl et al. | 254/45 |
| 4,765,594 | 8/1988 | Riedl et al. | 254/45 |
| 4,811,930 | 3/1989 | Riedl | 254/45 |

*Primary Examiner*—Robert C. Watson

*Attorney, Agent, or Firm*—Lowe, Price, LeBlanc & Becker

[57] ABSTRACT

In order to be able to handle containers of a height greater than the structural height of a rack and pinion jack in its retracted state, the top crosspiece of the rack and pinion jack is provided to be bent and provided with a double-acting engagement part. Thus, the top crosspiece can be brought into its top position with its engagement part engaging with the top corner metal fittings of a container of which the height exceeds that of the rack and pinion jack in a retracted state. By a simple 180° rotation of the top crosspiece, its engagement part can be brought into engagement with the top corner metal fittings of another container, having a different structural height. In this manner, the rack and pinion jacks can be adapted to any height setting of the top crosspiece by 180° rotation of the same to any two containers of different structural height. Thus the rack and pinion jacks are suitable even for containers of which the height lies below the level of the top articulation point of the bottom crosspiece of the rack and pinion jack.

10 Claims, 3 Drawing Sheets

A
27
29
11
13 A
22
45
20
28
10
25
13B
13 C
X
13D
37
13 E
20
21
23
14
33
36
17
32
19
15
16
34
35
12
18

RACK AND PINION JACK

BACKGROUND OF THE INVENTION

The invention relates to a rack and pinion jack for lifting, lowering and/or supporting containers, shelters or the like, wherein the engagement parts of two crosspieces cooperate with the corner metal fittings of the containers, which crosspieces, arranged on the cranking shaft at some spacing from one another, are associated with the top and/or bottom corner metal fittings, whereby the engagement part for the top corner metal fittings is arranged parallel to the cranking axis and the engagement part for the bottom corner metal fittings is arranged perpendicular to the cranking axis.

A rack and pinion jack of the aforementioned structural type is already known from U.S. Pat. No. 4,045,000. In this rack and pinion jack the top crosspiece is fastened at the top end of the cranking shaft and has a rod extending outward at a right angle to the cranking axis, at the outside end of which is arranged the engagement part for the top corner metal fittings of the container. This known rack and pinion jack is also suitable for handling containers of different heights, but operates within the limitation that the height of the container may not exceed the height of the rack and pinion jack in its initial state. In other words, said known rack and pinion jack is not suitable for containers which are of greater height than the rack and pinion jack in its initial state. At this point it is to be noted that the structural height of such rack and pinion jacks cannot be increased arbitrarily, because these rack and pinion jacks must be able to be stored in horizontal position following use, usually on the front wall of the container in suitable known holders. Thus the rack and pinion jacks may not project out to the side over the front walls of the container. The traditional breadth of the container is 8', and consequently the structural height of the rack and pinion jack in retracted state is also limited to this dimension. Now however for practical reasons containers are presently being used which even when they have the identical breadth of 8' have a greater structural height, and for these, as explained above, the known rack and pinion jack is not suitable. For this purpose then, longer special embodiments of rack and pinion jacks would be required, which are correspondingly more costly.

SUMMARY OF THE INVENTION

Therefore the object of the invention is to overcome the above problem and disclose a rack and pinion jack for handling containers of different structural heights, which can even exceed the height of the rack and pinion jack in its initial state.

The object is attained according to the invention in that the top crosspiece is offset and/or bent and is provided with a double-acting engagement part in such a manner that whatever the height setting of the top crosspiece on the cranking shaft, its engagement part can be connected with the top corner metal fittings of any two containers of different heights simply by 180° rotation of the crosspiece, and the engagement part, when it is in at least one setting position of the crosspiece on the cranking shaft, is positioned higher than the top end of the cranking shaft. The advantage is thus obtained that at least one container having a greater structural height than the rack and pinion jack in rest state can be manipulated with the rack and pinion jack according to the invention. The heights or lengths of these rack and pinion jacks can advantageously be such that they do not exceed the customary breadth of the container of for instance 8', so that, following use, the rack and pinion jack can be fastened in horizontal position on the front wall of such a container in traditional holders, without extending out to the side. The rack and pinion jack according to the invention is also considerably more adaptable than the known rack and pinion jack described above, because its top crosspiece can be adapted to any height position on the cranking shaft by simple 180° revolution of the crosspiece to adapt to two containers of different heights. When any number of different fastening settings or height settings of the top crosspiece on the cranking shaft is provided, a plurality of possibilities of use of the rack and pinion jack is thus obtained not only for containers of traditional heights, but also for otherwise modified containers or other sizes of containers or the like, which are of special, different structures.

When in the case of the rack and pinion jack it has to do with a construction wherein the bottom crosspiece has two fastening points on the cranking shaft arranged at considerable vertical spacing from one another, according to a further configuration of the invention the engagement part can be positioned on the top crosspiece in at least one adjustment setting of the crosspiece on the cranking shaft at a lower level than the top fastening point of the bottom crosspiece on the cranking shaft. Thus even containers of which the height is lower than the level of the top fastening point of the bottom crosspiece can be manipulated advantageously with this rack and pinion jack. With the known and described rack and pinion jack one cannot manipulate such low containers, because the top crosspiece extends at a right angle to the cranking axis out to the side over the top fastening point of the bottom crosspiece, so that its engagement part cannot be brought into connection with one of the top corner metal fittings of this lower container.

Still another feature of the invention is characterized in that the top crosspiece has two segments of which the one runs diagonally and the other at a right angle away from the cranking axis and at its outside end carries the double-acting engagement part. Such a crosspiece not only can be produced to be a stable hollow body, but also can be manufactured at low cost.

Still another feature of the invention is characterized in that the top crosspiece has three segments, of which the first runs parallel, the second diagonal and the third at a right angle to the cranking axis, in which the top crosspiece is arranged to be height-adjustable with the first segment on the cranking shaft. On the basis of these features, the engagement part of the top crosspiece can be adjusted simply and rapidly to the required height and brought into connection with a top corner metal fitting of the relevant container. This variation of embodiment also facilitates an additional adaptation of the rack and pinion jack to containers of different structural heights, whereupon the range of application of the jack is further increased.

A guide part on the cranking shaft is preferably provided with a detent to hold the top crosspiece in different height settings. Such a guide part can be simply fastened to traditional standard cranking shafts.

According to still another feature of the invention it is characterized in that the engagement part is arranged to be able to slide longitudinally at the outside end of the top crosspiece and is of such length that, according to the position of the crosspiece, it can be adjusted upward or downward by its outwardly projecting outside end. Thus, in the one setting of the crosspiece it is possible to rapidly and simply position the engagement part projecting downward and in the other setting of the crosspiece, to position the engagement part projecting upward.

BRIEF DESCRIPTION OF THE DRAWINGS

The invention is to be explained in greater detail hereinafter relative to the drawings of exemplary embodiments. In the drawings

DESCRIPTION OF THE PREFERRED EMBODIMENTS

Figures 1, 2:
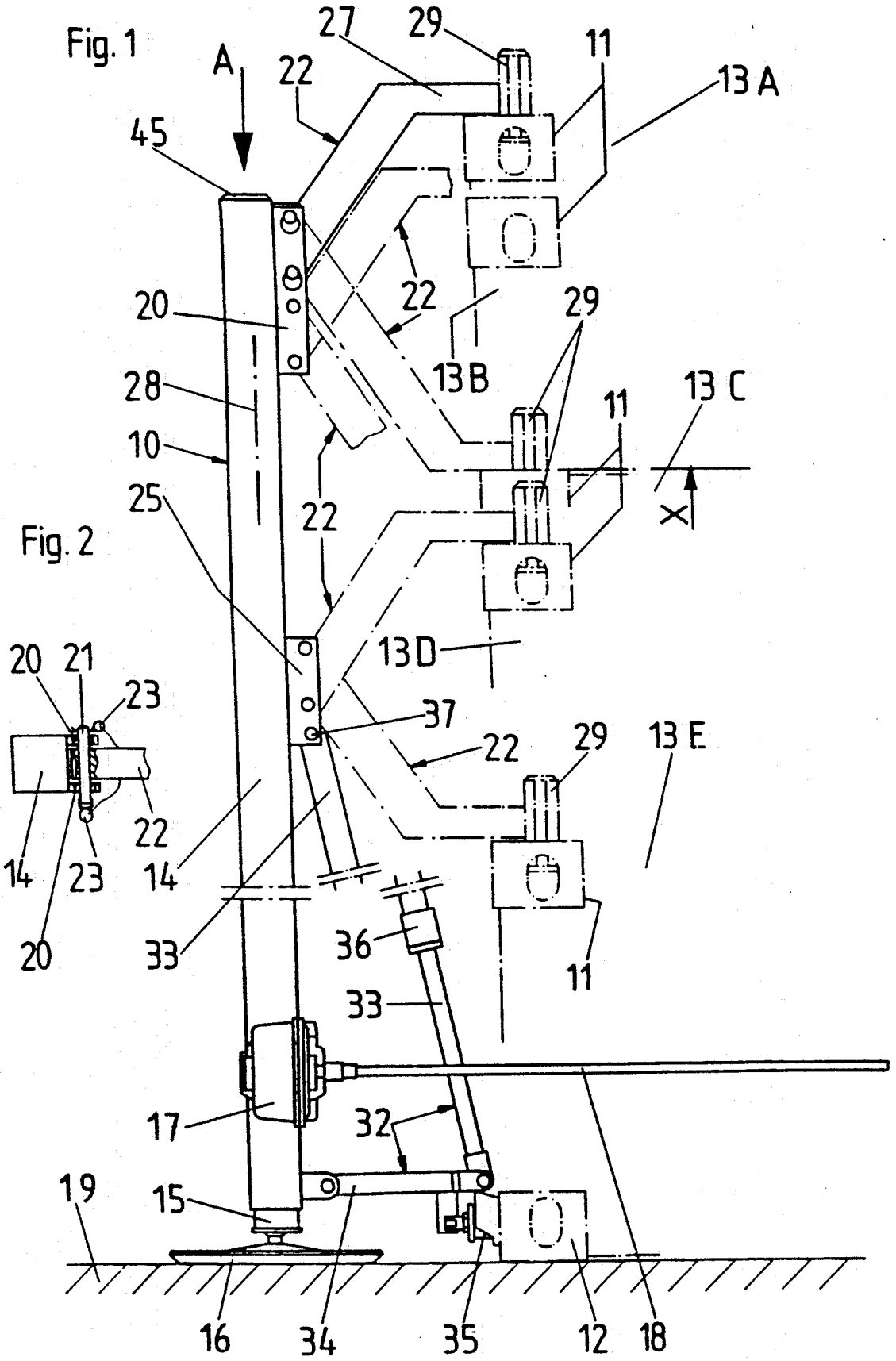
FIG. 1 is a side view of the rack and pinion jack according to the invention in operational setting, in which the top crosspiece of the rack and pinion jack is shown in full lines in a position of maximum height and in broken lines in various other height settings, including even in inverted setting, and even in connection with containers of different structural heights.
FIG. 2 is a plan view of the rack and pinion jack of FIG. 1 in area A.

In order to lift a container, for instance container 13 A or some other size container from a loading surface, for instance of a truck, and then for instance to place it on the ground or inversely to lift it from the ground and place it on the truck, four rack and pinion jacks 10 of the type shown in FIG. 1 are fastened to the standard top corner metal fittings 11 and bottom corner metal fittings 12 of container 13 A. Each of these four rack and pinion jacks 10 has a cranking shaft 14, a toothed rack 15 with a supporting foot 16, and a crank assembly 17 fastened to cranking shaft 14, which can be operated by a not shown, detachable manual crank. Crank assembly 17 and two adjacent rack and pinion jacks 10 are coupled with each other by a shaft 18 in drive assembly, so that it suffices simply to operate only two crank assemblies 17 by their manual cranks, in order in the case of the four rack and pinion jacks 10 to move the cranking shaft 14 along toothed rack 15 supported on the ground 19 and therewith to move the relevant container for instance 13 A upward or downward.

Figure 3:
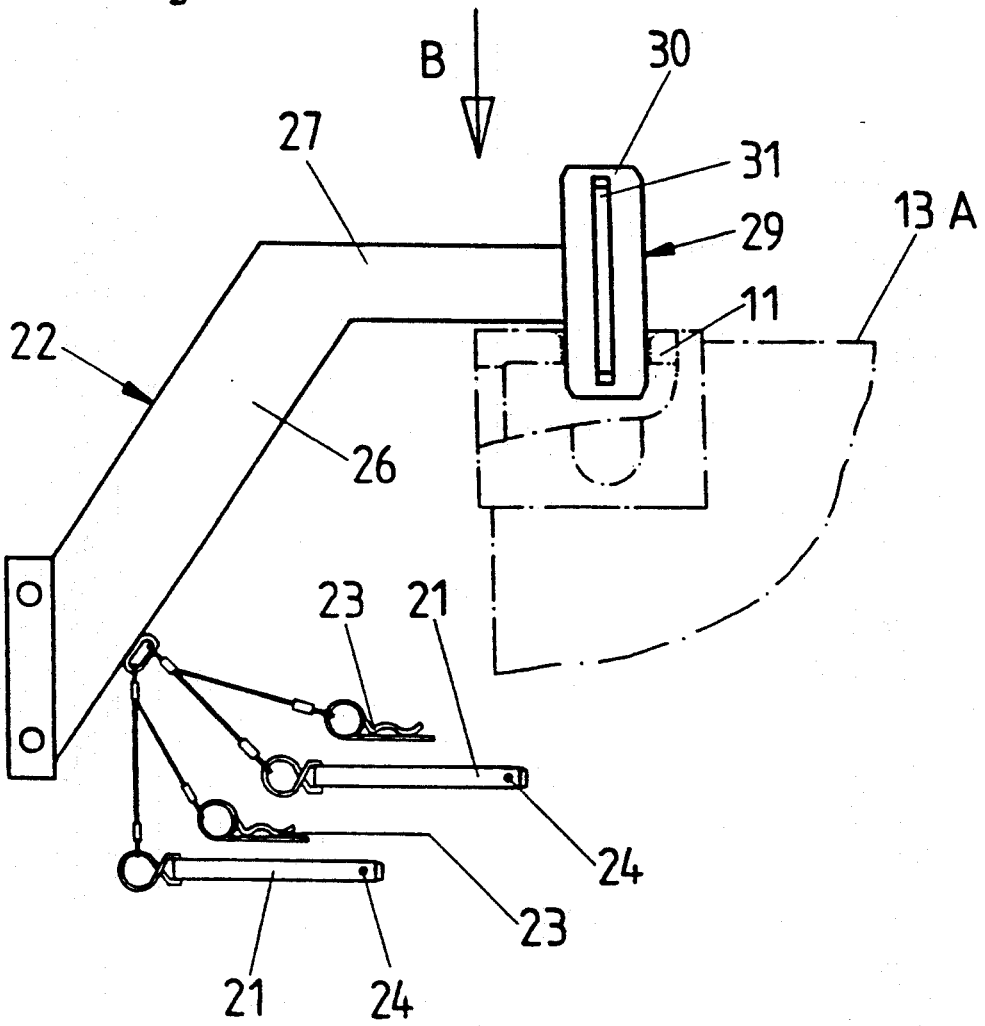
FIG. 3 is a side view of the top crosspiece of the rack and pinion jack of FIG. 1, of which the engagement part is shown in connection with a top corner metal fitting of a container indicated in broken lines.
Figure 4:
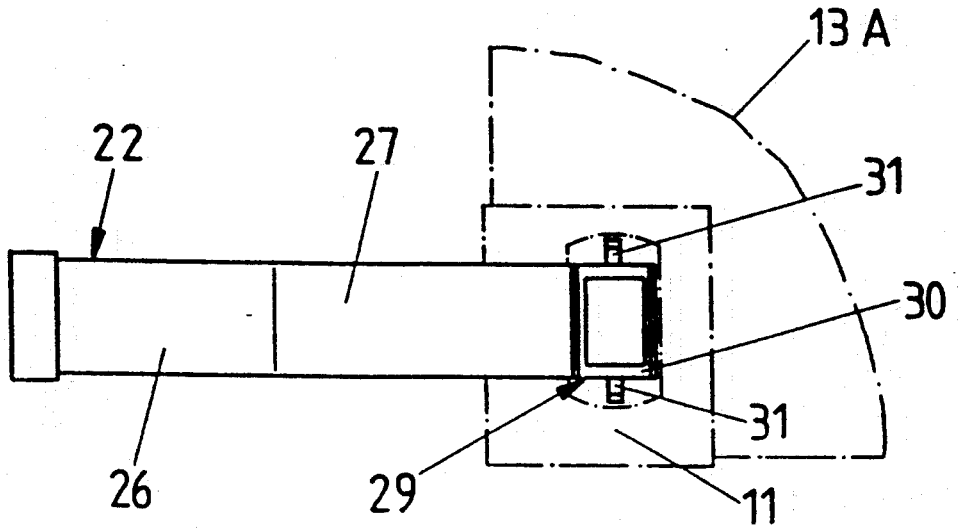
FIG. 4 is a plan view of the crosspiece shown in FIG. 3.

At the top end of cranking shaft 14, two anchoring straps 20 side by side at some distance from one another are each provided with two pairs of aligned bores on their sides, to which, by means of two cotter pins 21 (FIGS. 2 and 3), a top crosspiece 22 can be detachably anchored on cranking shaft 14. Cotter pins 21 could be blocked in their work position by retaining springs 23, which can be inserted into bores 24 in the ends of cotter pins 21.

Two more anchoring straps 25, each strap anchoring for instance one pair of side bores in alignment to receive cotter pins 21, are fastened at a certain distance from anchoring straps 20 on cranking shaft 14.

Top crosspiece 22 shown in FIGS. 1–4 for instance surrounds two square tubular members forming segments 26 and 27, of which in the assembled crosspiece 22 the one, 26, runs diagonal and the other runs at a right angle to cranking axis 28. Top crosspiece 22 is thus an offset and/or bent part, which at its outside end (on segment 27) supports a journal-like engagement part 29, which extends parallel to cranking axis 28. Engagement part 29 is composed of a tubular member 30 and two straps 31 fastened to its opposite side walls. It is of such length and is fastened to segment 27 of crosspiece 22 in such a manner that it projects with both ends along the same distance over this segment 27. Each outward-projecting end of engagement part 29 can as desired be brought into engagement with the corresponding opening of one of the top corner metal fittings 11 e.g. of container 13 A, which is to be explained hereinafter. What is involved is a double-acting engagement part 29, which in two different positions of crosspiece 22 can be inserted in a structural addition position added onto cranking shaft 14, which also is to be explained hereinafter.

The bottom crosspiece 32 associated with the bottom corner metal fittings 12 of container 13 A includes for instance two rods 33 and 34, which in turn are arranged articulately with one end on an engagement part 35 for the bottom corner metal fittings 12. Engagement part 35 extends perpendicular to cranking axis 28 and can be retracted to the side into the receiving opening of one of the bottom corner metal fittings 12. The other end of rod 34 is fastened by articulation to the bottom end of cranking shaft 14. Rod 33 is a telescoping rod, of which the two parts can be interlocked with one another by a tightener 36. The other end of rod 33 is articulated by means of a cotter pin 37 to both anchoring straps 25. With loosening of tightener 36, the length of rod 33 can be changed continuously.

Before the attachment of rack and pinion jack 10 to container 13 A, first of all top crosspiece 22 is fastened to cranking shaft 14 and bottom crosspiece 32 is brought into its work position (This process is described in U.S. Pat. No. 4,045,000.). Then the rack and pinion jack 10 which is thus prepared can be attached to container 13 A, and it is then arranged perpendicular to the ground 19. Cranking shaft 14 is raised by operation of crank assembly 17 by means of the manual crank, until the journal-like engagement part 29 can be guided from above downward into a top corner metal fitting 11. After this insertion of engagement part 29 crank assembly 17 is rotated somewhat to the rear, until the horizontal segment 27 of top crosspiece 22 engages on the associated corner metal fitting 11. In this position now the journal-like engagement part 35 on bottom crosspiece 32 can be introduced from the side into the associated corner metal fitting 12 and can be braced in this fitting in a known manner. Thus, rod 33 of bottom crosspiece 32 runs obliquely upward toward cranking shaft 14, while the other rod 34 extends nearly perpendicularly toward cranking shaft 14. In this manner all four rack and pinion jacks 10 are attached to container 13 A, and in this phase all of the rack and pinion jacks 10 are completely retracted. Then container 13 A can be raised by synchronous operation of the two crank assemblies 17 and can be placed on the loading surface of a truck. The above described attachment of rack and pinion jacks 10 to a container remains independent of the height setting and position of top crosspiece 22 on cranking shaft 14.

Because of special bending and/or offsetting of top crosspiece 22 and the use of a "double-acting" engagement part 29, with identical height setting of top crosspiece 22 on cranking shaft 14, by simple 180° rotation of crosspiece 22, the possibility exists of using rack and pinion jack 10 for manipulation of two containers 13 A and 13 C having different heights. The same is true in any height setting of top crosspiece 22 on cranking shaft 14 and it thus allows for the possibility of using rack and pinion jack 10 for a plurality of containers which are all of different heights. Therefore, in FIG. 1 top crosspiece 22 is for instance indicated partially in broken lines, showing only three different height settings, whereupon for instance five containers 13 A–13 E with different structural heights could be manipulated with four such rack and pinion jacks 10. With the containers 13 A, 13 B, 13 D and 13 E, shown partially in FIG. 1, these which are shown relate to certain useful heights, these being 8'6", 8', 6' and 4'3". Container 13 C of X height is indicated solely as an example for clarification of the invention in FIG. 1.

In FIG. 1 it is shown that crosspiece 22 shown in full lines with its engagement part 29 can be brought into engagement with one of the top corner metal fittings 11 of container 13 A, of which the height exceeds the structural height of rack and pinion jack 10 in retracted state (FIG. 1). This means that engagement part 29 in this adjusted setting of crosspiece 22 is positioned at a higher point than top end 45 of cranking shaft 14. At this point it is to be noted that rack and pinion jack 10 with retracted bottom crosspiece 32 and disassembled top crosspiece 22 has a height or length of 8' and thus in horizontal setting can be stored in suitable holders on the front wall of a traditional container, of which the breadth likewise is 8'.

With the same height setting of top crosspiece 22 on cranking shaft 14, with simple 180° rotation of crosspiece 22 into the setting shown in broken lines, engagement part 29 can be brought into engagement with for instance one of the top corner metal fittings 11 of container 13 C having X structural height.

Anchoring straps 20 on cranking shaft 14 furthermore also allow for a somewhat lower attachment of top crosspiece 22, so that its engagement part 29 can be brought into engagement with one of the top corner metal fittings 11 of container 13 B, of which the structural height is 8'. In the same height setting, once again by simple 180° rotation of crosspiece 22, rack and pinion jack 10 can be adapted to a not shown other container having a different structural height.

The two anchoring straps 25 arranged at a lower point on cranking shaft 14 allow for the fixing of top crosspiece 22 in two other settings at the same height, as is indicated in broken lines. Thus, rack and pinion jack 10 in one case can be adapted to container 13 D with structural height of 6' and in the other case to container 13 E with structural height of 4'3". At this point it is to be noted that container 13 E does not reach as high as articulation point 37 for rod 33 of bottom crosspiece 32. The manipulation of container 13 E using four rack and pinion jacks 10 is thus possible only because of the use of special crosspiece 22 of offset configuration, with double-acting engagement part 29. FIG. 1 shows that in this case the effective segment of engagement part 29 lies at a lower level than the top fastening or articulation point 37 of rod 33 of bottom crosspiece 32. For completeness it is to be noted that for manipulation of any one of the containers 13 A–13 E, all four required rack and pinion jacks 10 are equipped with identical top crosspiece 22.

Figure 5:
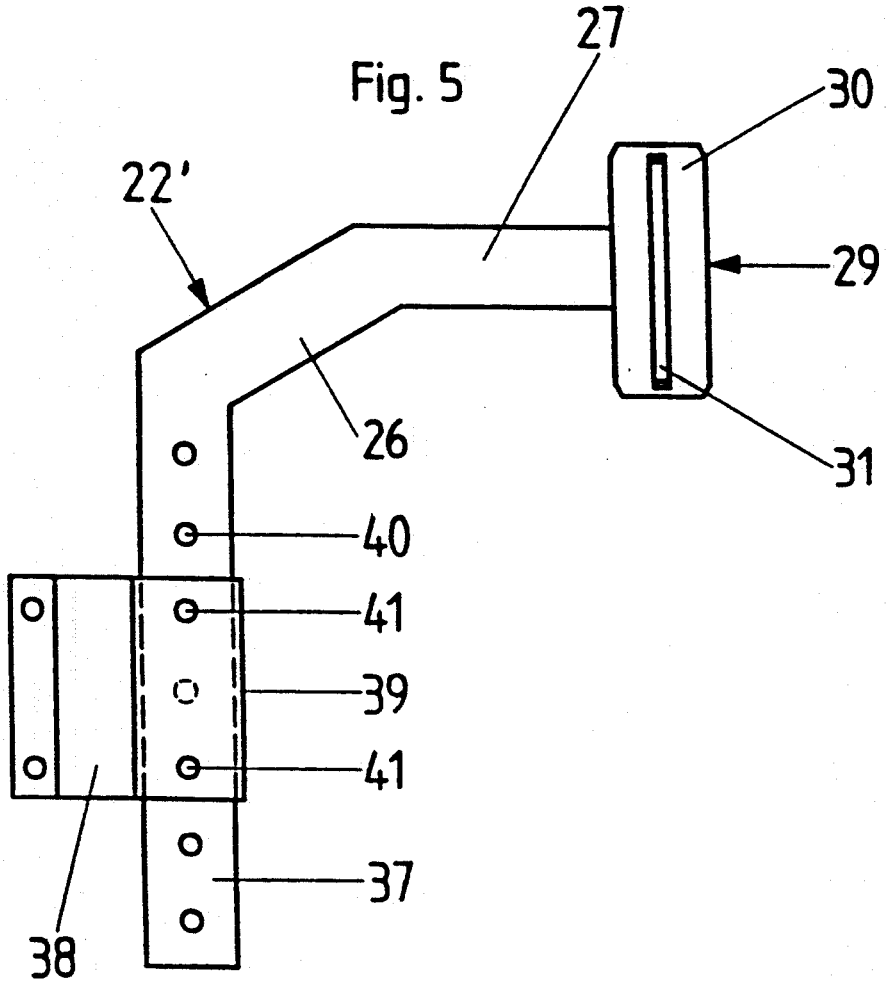
FIG. 5 is a side view of a different configuration of a top crosspiece for the rack and pinion jack of FIG. 1.

FIG. 5 shows different version of a top crosspiece 22' for the rack and pinion jack 10 of FIG. 1. This crosspiece 22' has three connected segments 37, 26 and 27. First segment 37 runs parallel to cranking axis 28, second segment 26 runs diagonally thereto and third segment 27 runs at a right angle to axis 28, as in the case of crosspiece 22 of FIGS. 1–4. A guide member 38 for crosspiece 22' can be fixed to anchoring straps 20 or 25 (FIG. 1) by means of not shown and interlockable cotter pins. This guide member 38 includes a tubular segment 39 in which crosspiece 22' is arranged with its segment 37 parallel to cranking axis 28 and height-adjustable therein. Segment 37 is provided with a series of bores 40 and segment 39 of guide part 38 is provided with two bores 41, which in turn can be brought into alignment with two bores 40 in segment 37 of crosspiece 22'. Not shown and interlockable cotter pins are guided through these aligned bores 40, 41 for blocking of crosspiece 22' in any adjustment setting. However it is also possible to adjust crosspiece 22' continuously in guide member 38 and to block it therein using traditional clamping means.

Figure 6:
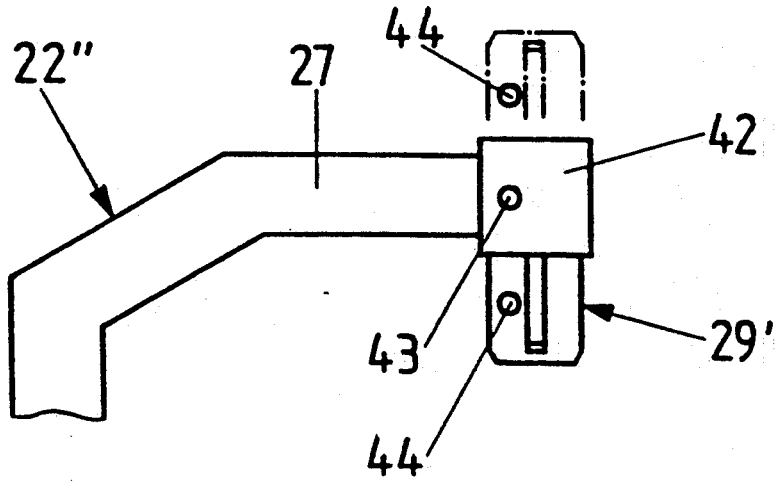
FIG. 6 is a side view of the outside end of a top crosspiece on which is provided a longitudinally slidable engagement part, which is indicated in full lines in a "bottom" setting and in broken lines in a "top" setting.

FIG. 6 shows the outside end of segment 27 of a crosspiece 22", to which is fastened a housing 42. Into housing 42 is slidably guided an engagement part 29', which corresponds to engagement part 29, but is designed to be shorter than part 29. The arrangement is such that engagement part 29' projects out as desired according to the setting of crosspiece 22", either upward or downward from housing 42. The blocking of engagement part 29' in one or the other setting occurs by a not shown, lockable cotter pin, which can be introduced through bores 43 in housing 42 and any one of the bores 44 in engagement part 29'.

What is claimed is:

1. Rack and pinion jack for lifting, lowering and supporting containers, shelters or the like of the type having top and bottom corner fittings, comprising a cranking shaft having a given height, means for moving said cranking shaft along a cranking axis, a bottom crosspiece connected with a lower portion of said cranking shaft, a first engagement part connected with said bottom crosspiece and operable to connect with a bottom corner fitting of a container to be lifted, a top crosspiece adjustably connected with said cranking shaft, a second engagement part connected with said top crosspiece and operable to connect with a top corner fitting of the container to be lifted, said top crosspiece having an offset configuration wherein for any given height at which said top crosspiece is connected to said cranking shaft, said second engagement part is operable to be selectively connected with a top corner fitting of a first container having a first height when said top crosspiece is in a first position, or a top corner fitting of a second container having a second height which is less than said first height when said top crosspiece is in a second position in which said top crosspiece is rotated approximately 180 degrees relative to said first position on said cranking shaft.

2. Rack and pinion jack as defined in claim 1, wherein said top crosspiece is constructed to be connected to the cranking shaft in at least one position wherein said second engagement part is positioned at a height which is greater than said height of said cranking shaft, thereby enabling the rack and pinion jack to be used with containers or the like which have a height greater than that of the cranking shaft.

3. Rack and pinion jack as defined in claim 1, wherein said second engagement part is constructed to be double acting such that said second engagement part is operable to connect with the top corner fitting of a container without modification when said top crosspiece is in said first and said second positions.

4. Rack and pinion jack as defined in claim 1, wherein said cranking shaft is provided with means for enabling the top crosspiece to be selectively connected to the cranking shaft at a plurality of different heights along said cranking axis.

5. Rack and pinion jack as defined in claim 1, wherein said bottom crosspiece is connected to said cranking shaft at upper and lower connection points, and further wherein said top crosspiece can be connected to said cranking shaft at at least one height wherein said second engagement part is positioned at a lower level than the position of said upper connecting point, thereby enabling the rack and pinion jack to be used with a container or the like which has a height which is less than the distance between said upper and said lower connection points.

6. Rack and pinion jack as defined in claim 1, wherein said upper crosspiece comprises a first portion which extends diagonally from said cranking shaft and is connected thereto, and a second portion secured to said first portion which extends substantially perpendicular to said cranking axis, said second engagement part being connected to said second portion adjacent an outer end thereof.

7. Rack and pinion jack as defined in claim 1, wherein said top crosspiece comprises a first portion which extends substantially parallel to said cranking shaft, a second portion which is secured to said first portion and extends diagonally to said cranking axis and a third portion which is secured to said second portion and extends substantially parallel to said cranking axis, said second engagement part being connected to said third portion adjacent an outer end thereof, and further wherein said first portion includes means for selectively connecting said first portion to said cranking shaft at a plurality of positions along the length of said first portion, thereby enabling said top crosspiece to be height adjustable.

8. Rack and pinion jack as defined in claim 7, and further including means for selectively locking said top crosspiece to said cranking shaft at a desired position on said first portion.

9. Rack and pinion jack as defined in claim 1, wherein said second engagement part is adjustably connected with said top crosspiece such that said second engagement part can be selectively connected to said top crosspiece at a plurality of different heights thereon.

10. Rack and pinion jack as defined in claim 1, wherein said top crosspiece comprises a first portion which extends substantially parallel to said cranking shaft and is connected thereto and a second portion which is connected to said first portion and extends substantially perpendicular to said cranking axis, said second engagement part being connected to said second portion adjacent an outer end thereof, and further wherein said first portion includes means for enabling said first portion to be connected to said cranking shaft at plurality of different positions on said first portion.

* * * * *